US005246618A

United States Patent [19]

Buchwald et al.

[11] Patent Number: 5,246,618

[45] Date of Patent: Sep. 21, 1993

[54] CLEANING COMPOSITIONS CONTAINING FLUOROCHLOROCARBON, C1 TO C4 ALKANOL AND ETHYL OR METHYL PROPIONATE

[75] Inventors: Hans Buchwald, Ronnenberg; Boleslaus Raschkowski, Wiedensahl; Dieter Singer, Laatzen, all of Fed. Rep. of Germany

[73] Assignee: Kali-Chemie AG, Fed. Rep. of Germany

[21] Appl. No.: 841,077

[22] Filed: Feb. 25, 1992

Related U.S. Application Data

[62] Division of Ser. No. 461,117, Jan. 4, 1990, Pat. No. 5,114,609.

[30] Foreign Application Priority Data

Jan. 13, 1989 [DE] Fed. Rep. of Germany ..... 3900804
Apr. 6, 1989 [DE] Fed. Rep. of Germany ..... 3911078

[51] Int. Cl.[5] ..... C11D 3/20; C11D 3/24; C11D 3/44; C11D 3/18

[52] U.S. Cl. ..... 252/171; 252/162; 252/170; 252/172; 252/153; 252/364; 252/DIG. 9; 134/12; 134/38; 134/39; 134/40; 203/67

[58] Field of Search ..... 252/153, 162, 170, 171, 252/172, 364, DIG. 9; 134/12, 38, 39, 40; 203/67

[56] References Cited

U.S. PATENT DOCUMENTS

| | | | |
|---|---|---|---|
| 3,113,155 | 12/1963 | Sims | 252/171 |
| 3,640,884 | 2/1972 | Schofield et al. | 252/171 |
| 3,856,696 | 12/1974 | Geiss et al. | 252/162 |
| 4,260,510 | 4/1981 | Hey et al. | 252/171 |
| 4,492,641 | 1/1985 | Buchwald et al. | 252/48.4 |
| 4,836,947 | 6/1989 | Lund et al. | 252/171 |
| 4,842,764 | 6/1989 | Lund et al. | 252/171 |

FOREIGN PATENT DOCUMENTS

| | | |
|---|---|---|
| 1248131 | 1/1989 | Canada . |
| 2942799 | 4/1980 | Fed. Rep. of Germany . |
| 3342852 | 6/1984 | Fed. Rep. of Germany . |
| 3335870 | 4/1985 | Fed. Rep. of Germany . |
| 2072328 | 9/1971 | France . |
| 2033422 | 5/1980 | United Kingdom . |
| 2046292 | 11/1980 | United Kingdom . |

*Primary Examiner*—Paul Lieberman
*Assistant Examiner*—Erin M. Higgins
*Attorney, Agent, or Firm*—Evenson, McKeown, Edwards & Lenahan

[57] ABSTRACT

Improved cleaning compositions are disclosed based on fluorochlorohydrocarbons, alkanols and at least one ester selected from the group consisting of methyl propionate, ethyl propionate and ethyl acetate. The compositions may optionally contain additional additives and are highly suitable for industrial cleaning processes or for vapor degreasing, for example, particularly for removing resin soldering fluxes containing high amounts of activator.

13 Claims, No Drawings

CLEANING COMPOSITIONS CONTAINING FLUOROCHLOROCARBON, C1 TO C4 ALKANOL AND ETHYL OR METHYL PROPIONATE

This application is a division of application Ser. No. 07/461,117, filed Jan. 4, 1990, now U.S. Pat. No. 5,114,609.

FIELD OF THE INVENTION

The present invention relates to improved cleaning compositions comprising fluorochlorohydrocarbons, alkanols and esters selected from the group consisting of ethyl propionate, methyl propionate and ethyl acetate.

BACKGROUND OF THE INVENTION

It is generally known in industrial cleaning processes or in vapor degreasing, besides using pure chlorinated and/or fluorinated hydrocarbons, to also use mixtures of fluorochlorohydrocarbons (as the principal solvent) with a co-solvent. Such mixtures may be either non-azeotropic or azeotropic or azeotrope-like. As used herein, the term "azeotrope-like" is understood to mean that mixtures throughout a fairly large concentration range boil at a substantially constant temperature (change in boiling temperature of not more than 5° C.) and therefore behave similarly to azeotropes for practical use.

A number of efforts have already been made to produce cleaning compositions with the desired properties. For instance, it is known from DE-OS 29 42 799 to use mixtures of trichlorotrifluoroethane with ethanol and methyl acetate to remove resin soldering fluxes.

However, the known mixtures are still in need of improvement as far as their use properties are concerned. In particular, in conjunction with the further industrial developments in the field of fluxes, new requirements have arisen with respect to the removal of these newly developed fluxes. These requirements are not always fulfilled, or frequently have only been fulfilled unsatisfactorily, by the known solvent mixtures. A need therefore exists for new solvent mixtures with special new properties.

SUMMARY OF THE INVENTION

It is therefore an object of the invention to provide new solvent mixtures which overcome the drawbacks of the prior art.

It is also an object of the invention to provide new solvent mixtures which are especially well suited for removing modern soldering fluxes.

These and other objects of the invention have been achieved in accordance with the invention by providing a composition consisting essentially of from 98.9 to 45 wt-% of a fluorochlorohydrocarbon with 1 to 3 carbon atoms, from 1.0 to 50 wt-% of an alkanol with 1 to 4 carbon atoms, and from 0.1 to 5 wt-% of an ester selected from the group consisting of ethyl propionate, methyl propionate and ethyl acetate.

DETAILED DESCRIPTION OF PREFERRED EMBODIMENTS

The invention relates in particular to compositions characterized by a content of 98.9 to 45 wt-% of a fluorochlorohydrocarbon with 1 to 3 carbon atoms, 1.0 to 50 wt-% of an alkanol with 1 to 4 carbon atoms and 0.1 to 5 wt-% of an ester selected from the group consisting of ethyl propionate, methyl propionate and ethyl acetate. The fluorochlorohydrocarbon constituent in the compositions according to the invention may in this case also be a mixture of different fluorochlorohydrocarbons with 1 to 3 carbon atoms. Likewise, the ester constituent in the compositions according to the invention may also be a mixture of the above-mentioned esters.

In a sub-variant of the invention, the compositions are characterised in that they contain 97.5 to 89.0 wt-% of the fluorochlorohydrocarbon, 2.0 to 8.0 wt-% of the alkanol and 0.5 to 3.0 wt-% of the ester.

Preferably those fluorochlorohydrocarbons are used which boil within a temperature range of from +20° C. to +120° C. at normal pressure. These are known as such and can be taken for instance from the Kaltron ®-Taschenbuch, Kali-Chemie AG, 6th edition, 1978, pages 14 to 16. Fluorochlorohydrocarbons with 1 to 2 carbon atoms, which are selected from the group trichlorofluoromethane, tetrachlorodifluoroethanes, trichlorotrifluoroethanes, tetrachloromonofluoroethanes, trichlorodifluoroethanes, dichlorotrifluoroethanes, dichlorodifluoroethanes and dichloromonofluoroethanes are particularly advantageous. Compositions with trichlorofluoromethane, tetrachlorodifluoroethanes, trichlorotrifluoroethanes, dichlorotrifluoroethanes and dichloromonofluoroethanes are preferred.

Tetrachlorodifluoroethanes within the scope of the invention include the isomeric fluorochlorohydrocarbons corresponding to the empirical formula $C_2Cl_4F_2$. They thus include the fluorochlorohydrocarbon 1,1,2,2-tetrachloro-1,2-difluoroethane (R112) and the isomeric 1,1,1,2-tetrachloro-2,2-difluoroethane (R112a) or mixtures thereof.

Trichlorofluoroethanes within the scope of the invention include the isomeric fluorochlorohydrocarbons corresponding to the empirical formula $C_2Cl_3F_3$. They thus include the fluorochlorohydrocarbon 1,1,2-trichloro-1,2,2-trifluoroethane (R113) and the isomeric 1,1,1-trichloro-2,2,2-trifluoroethane (R113a) or mixtures thereof.

Tetrachloromonofluoroethanes within the scope of the invention include the fluorochlorohydrocarbons bearing one hydrogen atom and having the empirical formula $C_2HCl_4F$. They thus include the two incompletely halogenated isomeric fluorochlorohydrocarbons 1,1,2,2-tetrachloro-2-fluoroethane (R121) and 1,1,1,2-tetrachloro-2-fluoroethane (R121a) or mixtures thereof.

Trichlorodifluoroethanes within the scope of the invention include the fluorochlorohydrocarbons bearing one hydrogen atom and having the empirical formula $C_2HCl_3F_2$. They thus include the three incompletely halogenated isomeric fluorochlorohydrocarbons 1,1,2-trichloro-2,2-difluoroethane (R122), 1,1,2-trichloro-1,2-difluoroethane (R122a) and 1,1,1-trichloro-2,2-difluoroethane (R122b) or mixtures thereof.

Dichlorotrifluoroethanes within the scope of the invention include the fluorochlorohydrocarbons bearing one hydrogen atom and having the empirical formula $C_2HCl_2F_3$. They thus include the three incompletely halogenated isomeric fluorochlorohydrocarbons 1,1-dichloro-2,2,2-trifluoroethane (R123), 1,2-dichloro-1,1,2-trifluoroethane (R123a) and 1,1-dichloro-1,2,2-trifluoroethane (R123b) or mixtures thereof.

Dichlorodifluoroethanes within the scope of the invention include the fluorochlorohydrocarbons bearing two hydrogen atoms and having the empirical formula $C_2H_2Cl_2F_2$. They thus include the four incompletely halogenated isomeric fluorochlorohydrocarbons 1,2-dichloro-1,2-difluoroethane (R132), 1,1-dichloro-2,2-difluoroethane (R132a), 1,2-dichloro-1,1-difluoroethane (R132b) and 1,1-dichloro-1,2-difluoroethane (R132c) or mixtures thereof.

Dichloromonofluoroethanes within the scope of the invention include the fluorochlorohydrocarbons bearing three hydrogen atoms and having the empirical formula $C_2H_3Cl_2F$. They thus include the three incompletely halogenated isomeric fluorochlorohydrocarbons 1,2-dichloro-1-fluoroethane (R141), 1,1-dichloro-2-fluoroethane (R141a) and 1,1-dichloro-1-fluoroethane (R141b) or mixtures thereof.

Particularly preferred compositions contain trichlorofluoromethane (R11), 1,1,2,2-tetrachloro-1,2-difluoroethane (R112), 1,1,2-trichloro-1,2,2-trifluoroethane (R113), 1,1,2,2-tetrachloro-2-fluoroethane (R121), 1,1,2-trichloro-2,2-difluoroethane (R122), 1,1-dichloro-2,2,2-trifluoroethane (R123), 1,2-dichloro-1,2-difluoroethane (R132) and 1,1-dichloro-1-fluoroethane (R141b). 1,1,2-Trichloro-1,2,2-trifluoroethane (R113), for instance, has proved particularly advantageous as the fluorochlorohydrocarbon. However, compositions with 1,1-dichloro-1-fluoroethane (R141b), 1,1-dichloro-2,2,2-trifluoroethane (R123), 1,1,2 2-tetrachloro-1,2-difluoroethane (R112) or trichlorofluoromethane (R11) also provide very good results.

The alkanols with 1 to 4 carbon atoms used in the compositions according to the invention are selected from the group methanol, ethanol, isopropanol, n-propanol, n-butanol, sec.-butanol and tert.-butanol, preferably methanol, ethanol and isopropanol. Ethanol has proved particularly advantageous. However, methanol and isopropanol are each also well suited.

In a very advantageous embodiment of the invention, the compositions are characterised by an azeotropic behavior and a content of approximately 94.2 wt-% 1,1,2-trichloro-1,2,2-trifluoroethane, 3 wt-% ethanol and 2.3 wt-% ethyl acetate.

The compositions according to the invention are clear solutions at room temperature and may have known additives added to them. One group of known additives is stabilizers. This group comprises those compounds which prevent an unwanted reaction of constituents of the composition with each other or with other reactants, such as atmospheric oxygen, water, metal etc. Known stabilizers include, for example, the nitroalkanes, in particular nitromethane and nitroethane; alkylene oxides, in particular butylene oxide; or branched alkynols such as 2-methyl-butyn-(3)-ol-(2). These stabilizers may be used individually or in combination. Stabilizer quantities of 0.01 to 5 wt-%, preferably 0.05 to 1 wt-%, relative to the total mixture, are very suitable.

Another group of additives comprises known compounds of the group of corrosion inhibitors, non-ionic or ionic emulsifiers, coloring agents, etc.

The aforedescribed compositions have numerous possibilities for use in the fields of cleaning and/or vapor degreasing. In these processes, the object which is to be cleaned is immersed in a liquid and/or vaporous cleaning mixture in one or more stages, or is sprayed with liquid cleaning mixture. The cleaning action can be increased in such processes by using elevated temperature and/or ultrasound and/or stirring. Likewise, it is possible to improve the cleaning action by mechanical action such as brushing.

For example, the electronics industry uses predominantly organic resin fluxes for soldering processes on circuit boards. After the soldering operation, excess flux has to be removed from the boards. This is done using organic solvents which are compatible with the circuit boards and with the electronic components, that is to say the solvent must not react therewith. The resin fluxes to be removed are mixtures of polar and non-polar compounds, and often additionally contain special activators. Fluorinated hydrocarbons alone, which are not polar, are not effective in removing the polar constituents of the resins. Known mixtures which contain an alcohol in addition to fluorinated hydrocarbons are similarly incapable of fully removing fluxes, especially fluxes which contain high amounts of activator. However, the compositions according to the invention can remove both the polar and the non-polar constituents and are therefore widely effective as removers for resin fluxes, in particular for those having a high activator content. Compositions of R113/ethanol/ethyl acetate, in particular in an azeotropic composition of 94.2%/3.5%/2.3%, are especially well suited for this use. However, other compositions of R113, for instance also with the alcohols methanol or isopropanol and an ester from the group ethyl propionate, methyl propionate or ethyl acetate, give very good results, as do compositions according to the invention with R141b, R123, R112 or R11.

For instance, equipped and non-equipped (and in particular SMD-equipped) circuit boards can be cleaned without difficulty using the compositions according to the invention, even when fluxes having high activator contents are used, without the "white deposits" which are to be feared when using conventional cleaning agents.

The new compositions according to the invention are also desirable systems for cooling agents and/or lubricants, since the compositions have a low surface tension, a low viscosity and for the most part a high density of about 1.4 to 1.6 g/cm$^3$ at 20° C. The foregoing physical properties are those which are desired for lubricant purposes. For instance, the compositions according to the invention are desired if the mixture is used as a lubricant in metalworking machines, such as during boring, milling, turning, thread-cutting, punching or the like, where a residue-free surface is necessary. For these uses in particular, known lubricant additives (such as those described in DE-OS 33 42 852 or DE-OS 33 35 870) may also be added.

The low surface tension, the high wetting power and density of the compositions according to the invention make them particularly suitable for cleaning capillary systems.

The compositions according to the invention may, for example, also be used as follows:

for cleaning small parts or loose material (preferably in closed installations), for stripping varnish, as special solvents, extraction agents and/or recrystallisation agents in the chemical and pharmaceutical industries.

As mentioned at the beginning, cleaning compositions which contain the fluorochlorohydrocarbon 1,1,2-trichloro-1,2,2-trifluoroethane, ethanol and methyl acetate ester and which are used for removing resin soldering fluxes are already known from DE-OS 29 42 799. However, using these methyl acetate-containing compositions does not assure in every case the very high degree of cleanliness which is required in special fields of use, for instance for cleaning components and printed circuit boards in the electronics industry. Their properties are therefore in part just as inadequate as the fluorochlorohydrocarbon/alklanol compositions known in the prior art without an additive such as methyl acetate. It is therefore all the more surprising that the new mixtures according to the invention, which contain fluorochlorohydrocarbons, alkanols and as an additive the esters ethyl propionate, methyl propionate and/or ethyl acetate, have superior cleaning properties and are very well suited for the above-mentioned uses. The mixtures according to the invention permit new solutions to problems over a wide field of application. In particular, mixtures of, for instance, 1,1,2-trichloro-1,2,2-trifluoroethane (R113), ethanol and ethyl acetate (see Table 1, No. 15, boiling point approx. 44.3° C.) or of 1,1,2-trichloro-1,2,2-trifluoroethane (R113), ethanol and ethyl acetate/methyl propionate (see Table 1, No. 14, boiling point approx. 45.6° C.) also exhibit no flash points (open-crucible method).

The following examples are intended to explain the invention in greater detail, but without limiting its scope. Unless otherwise stated, percentages are always percentages by weight.

EXAMPLE 1

Cleaning of Printed Circuit Boards

Cleaning tests with printed circuit boards which were contaminated with solvent fluxes containing high amounts of activator were carried out in a commercially available two-chamber or three-chamber cleaning unit. The cleaning compositions, cleaning conditions and cleaning results are listed in the following Table 1.

TABLE 1

| No. | Composition of Bath 1 | Cleaning conditions | Result |
|---|---|---|---|
| 1 | R141b/ethanol/ methyl propionate: 95.%/3.0%/2.0% | 2-bath: 1) 3 min. ultrasound 2) 1 min. vapor degreasing (in bath 2: R113) | + |
| 2 | R141b/ethanol/ ethyl acetate: 95.0%/3.0%/2.0% | 2-bath: 1) 3 min. ultrasound 2) 1 min. vapor degreasing (in bath 2: R113) | + |
| 3 | R141b/methanol/ ethyl acetate: 94.0%/3.7%/2.3% | 2-bath: 1) 3 min. ultrasound 2) 1 min. vapor degreasing (in bath 2: R113) | ++ |
| 4 | R123/ethanol/ ethyl acetate: 95.8%/2.5%/1.7% | 2-bath: 1) 3 min. ultrasound 2) 1 min. vapor degreasing (in bath 2: R113) | + |
| 5 | R123/ethanol/ ethyl acetate: 94.2%/3.5%/2.3% | 2-bath: 1) 3 min. ultrasound 2) 1 min. vapor degreasing (in bath 2: R113) | ++ |
| 6 | R123/methanol/ ethyl acetate: 94.2%/3.5%/2.3% | 2-bath: 1) 3 min. ultrasound 2) 1 min. vapor degreasing (in bath 2: R113) | ++ |
| 7 | R113/isopropanol/ ethyl acetate: 95.7%/2.3%/2.0% | 2-bath: 1) 3 min. ultrasound 2) 1 min. vapor degreasing (in bath 2: R113) | + |
| 8 | R113/isopropanol/ ethyl acetate: 47.0%/50.0%/3.0% | 3-bath: 1) 3 min. ultrasound 2) 1 min. ultrasound 3) 1 min. vapor degreasing (in bath 2 & 3: R113) | ++ |
| 9 | R113/isopropanol: 97.4%/2.6% (azeotropic) | 2-bath: 1) 3 min. ultrasound 2) 1 min. vapor degreasing (in bath 2: R113) | − |
| 10 | R113/isopropanol: 65.0%/35.0% | 3-bath: 1) 3 min. ultrasound 2) 1 min. ultrasound 3) 1 min. vapor degreasing (in bath 2 & 3: R113) | − |
| 11 | R113/ethanol/ ethyl propionate: 94.2%/3.5%/2.3% | 2-bath: 1) 3 min. ultrasound 2) 1 min. vapor degreasing (in bath 2: R113) | ++ |
| 12 | R113/ethanol/ methyl propionate: 93.9%/3.5%/2.6% | 2-bath: 1) 3 min. ultrasound 2) 1 min. vapor degreasing (in bath 2: R113) | ++ |
| 13 | R113/methyl propionate: 97.3%/2.7% (azeotrope-like) | 2-bath: 1) 3 min. ultrasound 2) 1 min. vapor degreasing (in bath 2: R113 | − |
| 14 | R113/ethanol/ methyl propionate/ ethyl acetate: 93.8%/3.4%/1.3%/1.5% (azeotrope-like) | 2-bath: 1) 3 min. ultrasound 2) 1 min. vapor degreasing (in bath 2: R113) | + |
| 15 | R113/ethanol/ ethyl acetate: 94.2%/3.5%/2.3% (azeotrope-like) | 2-bath: 1) 3 min. ultrasound 2) 1 min. vapor degreasing (in bath 2: R113) | ++ |
| 16 | R113/ethanol 96.2%/3.8% (azeotropic) | 2-bath: 1) 3 min. ultrasound 2) 1 min. vapor degreasing (in bath 2: R113) | − |
| 17 | R113/ethanol/ methyl acetate: 94.2%/3.7%/2.1% (azetrope-like) | 2-bath: 1) 3 min. ultrasound 2) 1 min. vapor degreasing (in bath 2: R113) | − |
| 18 | R113/ethanol/ methyl acetate/ nitromethane: 94.15%/3.7%/2.1%/0.05% (azeotrope-like) | 2-bath: 1) 3 min. ultrasound 2) 1 min. vapor degreasing (in bath 2: R113) | − |
| 19 | R113/ethanol/ ethyl acetate: 68.0%/30.0%/2.0% | 3-bath: 1) 3 min. ultrasound 2) 1 min. ultrasound 3) 1 min. vapor degreasing (in bath 2 & 3: R113) | ++ |
| 20 | R113/ethanol: 65.0%/35.0% | 3-bath: 1) 3 min. ultrasound 2) 1 min. ultrasound 3) 1 min. vapor degreasing (in bath 2 & 3: R113) | − |
| 21 | R113/methanol/ ethyl acetate: 92.5%/6.0%/1.5% | 2-bath: 1) 3 min. ultrasound 2) 1 min. ultrasound (in bath 2: R113) | ++ |
| 22 | R113/methanol/ ethyl acetate/ nitromethane: 92.2%/6.0%/1.5%/0.3% | 2-bath: 1) 3 min. ultrasound 2) 1 min. vapor degreasing (in bath 2: R113) | ++ |
| 23 | R113/methanol: 93.5%/6.5% (azeotropic) | 2-bath: 1) 3 min. ultrasound 2) 1 min. vapor degreasing (in bath 2: R113) | − |
| 24 | R112/ethanol/ ethyl acetate: 94.2%/3.5%/2.3% | 2-bath: 1) 3 min. ultrasound 2) 1 min. vapor degreasing | ++ |

TABLE 1-continued

| No. | Composition of Bath 1 | Cleaning conditions | Result |
|---|---|---|---|
| 25 | R11/ethanol/ ethyl acetate: 96.5%/2.0%/1.5% | (in bath 2: R113) 2-bath: 1) 3 min. ultrasound 2) 1 min. vapor degreasing (in bath 2: R113) | + |
| 26 | R11/ethanol/ ethyl acetate: 94.2%/3.5%/2.3% | 2-bath: 1) 3 min. ultrasound 2) 1 min. vapor degreasing (in bath 2: R113) | ++ |

In the cases characterised by "++" in the "Result" column, a very good cleaning effect was achieved, and a good cleaning effect was achieved in those cases characterised by "+", and there was no formation of "white deposits". In the cases characterised by "−", "white deposits" were formed.

It can clearly be seen that the compositions according to the invention (tests 1 to 8, 11, 12, 14, 15, 19, 21, 22, 24 to 26) are superior to the mixtures according to the prior art (tests 9, 10, 13, 16 to 18, 20 and 23).

EXAMPLE 2

Cleaning of Bulk Material

Loose material (transistor caps) was cleaned in a two chamber unit (3 minutes ultrasound, 1 minute vapor degreasing) with an azeotropic mixture of 94.2% R113, 3.5% ethanol and 2.3% ethyl acetate in order to remove drawing oils. The loose material was satisfactorily clean after treatment.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include everything falling within the ambit of the apprended claims and equivalents thereof.

What is claimed is:

1. A composition consisting essentially of from 97.5 to 89.0 wt-% of a fluorochlorohydrocarbon selected from the group consisting of the dichlorotrifluoroethanes and the dichloromonofluoroethanes, from 2.0 to 8.0 wt-% of an alkanol with 1 to 4 carbon atoms, and from 0.5 to 3 wt-% of an ester selected from the group consisting of ethyl propionate and methyl propionate.

2. A composition according to claim 1, wherein said fluorochlorohydrocarbon is selected from the group consisting of 1,1-dichloro-2,2,2-trifluoroethane (R123) and 1,1-dichloro-1-fluoroethane (R141b).

3. A composition consisting essentially of from 97.5 to 89.0 wt-% of dichlorotrifluoroethane, from 2.0 to 8.0 wt-% of an alkanol with 1 to 4 carbon atoms, and from 0.5 to 3 wt-% of an ester selected from the group consisting of ethyl propionate and methyl propionate.

4. A composition according to claim 1, wherein said dichlorotrifluoroethane is 1,1-dichloro-2,2,2-trifluoroethane (R123).

5. A composition according to claim 1, wherein said alkanol is selected from the group consisting of methanol, ethanol, isopropanol, n-propanol, n-butanol, sec.-butanol and tert.-butanol.

6. A composition according to claim 5, wherein said alkanol is selected from the group consisting of methanol, ethanol and isopropanol.

7. A composition according to claim 1, further comprising from about 0.01 to 5 wt-% of a stabilizer selected from the group consisting of nitroalkanes, alkaline oxides and alkanols, relative to the total weight of the composition.

8. A composition according to claim 7, containing from about 0.05 to 1 wt-% stabilizer, relative to the total weight of the composition.

9. A method of cleaning an article comprising contacting said article with a composition according to claim 1.

10. A method according to claim 9, whereins said contacting is effected by immersing the article to be cleaned in said composition.

11. A method according to claim 9, wherein said contacting is effected by spraying said composition on the article.

12. A method of vapor degreasing an article comprising subjecting an article to be vapor degreased to the vapors of a composition according to claim 1.

13. A method of removing soldering flux or soldering flux residue from the surface of a printed circuit board contaminated therewith, said method comprising contacting the surface of said printed circuit board with a composition according to claim 1.

* * * * *